US009427039B2

(12) United States Patent
Eustace

(10) Patent No.: US 9,427,039 B2
(45) Date of Patent: Aug. 30, 2016

(54) SYSTEMS AND METHODS FOR COMMUNICATING HELMET USAGE INFORMATION DURING OPERATION OF AN ACTIVITY DEVICE

(71) Applicant: Katelyn Eustace, Menlo Park, CA (US)

(72) Inventor: Katelyn Eustace, Menlo Park, CA (US)

( * ) Notice: Subject to any disclaimer, the term of this patent is extended or adjusted under 35 U.S.C. 154(b) by 33 days.

(21) Appl. No.: 14/483,310

(22) Filed: Sep. 11, 2014

(65) Prior Publication Data

US 2016/0073722 A1 Mar. 17, 2016

(51) Int. Cl.
*A42B 3/04* (2006.01)
*G08B 21/18* (2006.01)

(52) U.S. Cl.
CPC ..... *A42B 3/0466* (2013.01); *G08B 21/18* (2013.01)

(58) Field of Classification Search
CPC ..... A42B 3/0466; G08B 21/18
See application file for complete search history.

(56) References Cited

U.S. PATENT DOCUMENTS

| | | | | |
|---|---|---|---|---|
| 5,294,914 | A | 3/1994 | Dallas | |
| 5,697,099 | A | 12/1997 | Siska, Jr. et al. | |
| 5,861,808 | A | 1/1999 | Lehmann et al. | |
| 7,973,652 | B1 * | 7/2011 | Smith | A42B 3/0466 2/421 |
| 2012/0188083 | A1 * | 7/2012 | Miller, II | A42B 3/046 340/573.1 |
| 2013/0057391 | A1 | 3/2013 | Salvador et al. | |
| 2015/0156567 | A1 * | 6/2015 | Oliver | H04Q 9/00 340/870.07 |
| 2015/0305426 | A1 * | 10/2015 | Lee | A42B 3/046 340/539.12 |

OTHER PUBLICATIONS

Garz, "How to Make a Bicycle Helmet Reminder, Similar to a Vehicle Seat Belt Reminder", Yahoo Voices, Posted on Jul. 9, 2013, 3 pgs.
A Public Service Initiative by the Traffic Police Bangalore City, "The Good Road", http://thegoodroad.in/main_page.php, Accessed on Jun. 5, 2014, 4 pgs.
Vineethvarma, "Bike That Won't Start Without Helmet", www.Youtube.com, Accessed on Jun. 5, 2014, 1 pg.
Kenny, "Smart Helmet Ensures Bike Won't Start Unless You Wear It", www.multiband-antennas.com/blog/smart-helmet-ensures-wont-start-unless-you-wear-it, Posted on May 8, 2014, 3 pgs.
Mehta, "Bike Won't Start If You Are Without Helmet or Drunk", *The Times of India*, Posted on Jul. 30, 2013, 5 pgs.
Docvia, LLC, "ICEdot", https://icedot.org/site/crash-sensor/?lang=en, Accessed on Jun. 6, 2014, 2 pgs.

* cited by examiner

*Primary Examiner* — Leon Flores
(74) *Attorney, Agent, or Firm* — Dority & Manning, P.A.

(57) ABSTRACT

Systems and methods for communicating helmet usage information during operation of an activity device are provided. One example aspect of the present disclosure is directed to a system for communicating helmet usage and includes one or more position sensors, one or more activity sensors and one or more computing devices. The one or more position sensors can be configured to be positioned on a helmet, to detect placement of the helmet on a user's head and to transmit signals indicative of such placement. The one or more activity sensors can be configured to be positioned on an activity device, to detect operational indicators relative to the usage of the activity device and to transmit signals indicative of such operational indicators. The one or more computing devices can be configured to: receive signals from the one or more position sensors and the one or more activity sensors, determine whether the activity device is likely engaged in one or more given activities, and generate/communicate at least one helmet usage indication signal to a user of the activity device and/or to a third party via a remote device.

20 Claims, 4 Drawing Sheets

SYSTEMS AND METHODS FOR COMMUNICATING HELMET USAGE INFORMATION DURING OPERATION OF AN ACTIVITY DEVICE

FIELD

The present disclosure relates generally to systems and methods of communicating helmet usage. In particular, the present disclosure is directed to systems and methods for alerting users and/or third parties regarding proper and/or improper helmet usage during operation of an activity device.

BACKGROUND

Safety helmets are commonly used to protect against potential head injuries resulting from a variety of activities, including riding bicycles, motorcycles and other transportation devices as well as engaging in sports or other potentially high-impact activities. The helmet is arguably the single most effective safety device available to provide protection for a user's head, brain and face and to mitigate the risk of head injury and death from bicycle crashes. Some studies indicate that helmets can reduce the risk of brain injuries by 88 percent in the event of an accident.

Given the effective protection afforded by safety helmets, it would be beneficial if more bicyclists, sports players and other transportation device operators or riders would wear a helmet with more consistency. Parents especially may desire to ensure that their children are wearing a safety helmet while operating a bicycle or other activity device. Some reported data indicates that every year 300,000 children go to the emergency room because of bicycle related injuries, and at least 10,000 children have injuries that require multiple days in the hospital. Some of these injuries are so serious that they result in death, usually from head injuries. Features for helping ensure proper usage of safety helmets would help mitigate the risk of such serious injuries in many users, including both children and adults.

Other known applications of safety features include those used in automotive technology. Vehicle safety features including lights and audible alarms have been used to remind vehicle occupants to engage their seat belts before operating a vehicle. Such seatbelt usage reminders have proven advantageous in ensuring proper seatbelt usage, and thus significantly reducing the likelihood of serious injuries during the unfortunate event of a passenger vehicle crash. As such, new technology is desired that would reduce the number of head related injuries to users of an activity device by providing safety features that help ensure that they are properly using a safety helmet.

SUMMARY

Aspects and advantages of the present disclosure will be set forth in part in the following description, or may be obvious from the description, or may be learned through practice of embodiments of the present disclosure.

One example aspect of the present disclosure is directed to a system for communicating helmet usage, comprising one or more position sensors, one or more activity sensors and one or more computing devices. The one or more position sensors can be configured to be positioned on a helmet, to detect placement of the helmet on a user's head and to transmit signals indicative of such placement. The one or more activity sensors can be configured to be positioned on an activity device, to detect operational indicators relative to the usage of the activity device and to transmit signals indicative of such operational indicators. The one or more computing devices can be configured to: receive signals from the one or more position sensors and the one or more activity sensors, determine whether the activity device is likely engaged in one or more given activities, and generate at least one helmet usage indication signal. Additional or alternative features can be included in other examples.

Another example aspect of the present disclosure is directed to a method of communicating helmet usage during operation of an activity device. A first exemplary step involves determining, by one or more computing devices associated with an activity device, when the activity device is engaged in a given activity. A second exemplary step involves detecting, by the one or more computing devices, position sensor information received from one or more position sensors associated with a helmet in proximity to the activity device. A third exemplary step involves providing, by the one or more computing devices, helmet usage information to a peripheral device associated with the activity device. Additional or alternative steps can be included in other examples.

These and other features, aspects and advantages of the present disclosure will become better understood with reference to the following description and appended claims. The accompanying drawings, which are incorporated in and constitute a part of this specification, illustrate embodiments of the present disclosure and, together with the description, serve to explain the principles of the present disclosure.

BRIEF DESCRIPTION OF THE DRAWINGS

A full and enabling description of the present disclosure, directed to one of ordinary skill in the art, is set forth in the specification, which makes reference to the appended figures, in which.

DETAILED DESCRIPTION

Figure 1:
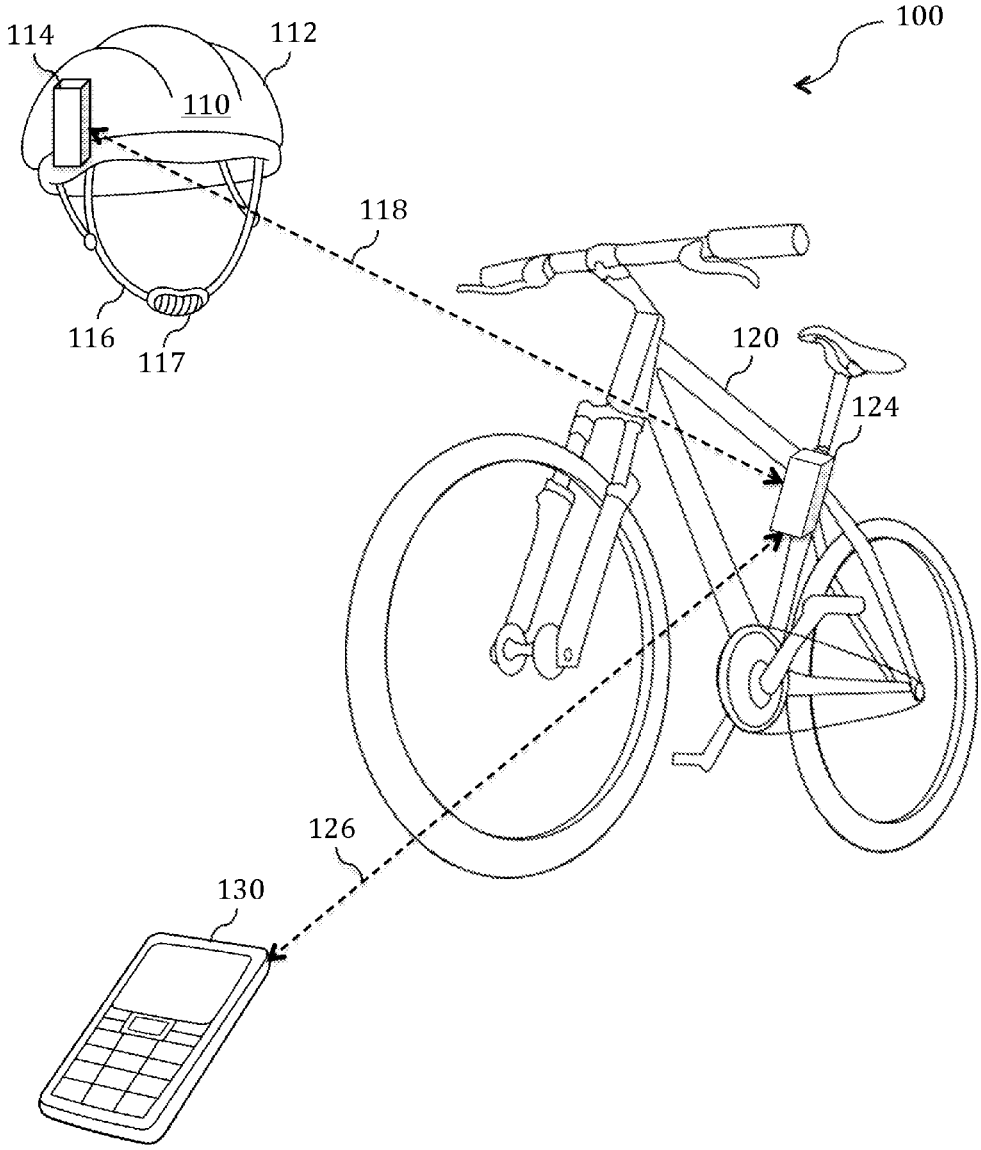
FIG. 1 depicts an example system for communicating helmet usage according to an example embodiment of the present disclosure.

Reference now will be made in detail to embodiments of the present disclosure, one or more examples of which are illustrated in the drawings. Each example is provided by way of explanation of the present disclosure, not limitation of the present disclosure. In fact, it will be apparent to those skilled in the art that various modifications and variations can be made to the present disclosure without departing from the scope or spirit of the disclosure. For instance, features illustrated or described as part of one embodiment can be used with another embodiment to yield a still further embodiment. Thus, it is intended that the present disclosure covers such modifications and variations as come within the scope of the appended claims and their equivalents.

Overview

Generally, the present disclosure is directed to systems and methods for communicating helmet usage information. In particular, helmet usage is monitored upon detecting that an activity device, e.g., a bicycle, transportation device, sporting device or equipment or the like, is engaged in one or more given activities. Helmet usage information may then be communicated to the user of the activity device, for example, in the form of an alarm if the helmet is improperly positioned during operation. Helmet usage information may also be communicated remotely to a third party, for example, a parent who is interested in ensuring proper helmet usage for a child.

According to an aspect of the present disclosure, monitoring and communication of helmet usage information will advantageously improve proper helmet usage among users of activity devices. Proper helmet usage can help prevent head, brain, and face injuries for users of personal transportation devices, including motorized and non-motorized vehicles including but not limited to bicycles, scooters, skateboards, motorcycles, go-karts, gliders, automobiles and the like. Potential injuries may also be avoided by proper helmet usage during operation of sports-related activity devices, such as but not limited to rock-climbing equipment, hockey or lacrosse sticks, and an unlimited variety of other sports equipment and related devices.

According to an aspect of the present disclosure, monitoring and communication of helmet usage information helps improve user safety by communicating such information in one or more of a variety of manners. By alerting a user of an activity device as to the unavailability of a helmet and/or the improper positioning and/or securing of a helmet, the user will ideally be more inclined to remedy the situation and ensure proper helmet positioning. By alerting a third party of similar helmet usage information, more accountability is provided to ensure a user's compliance with desired helmet safety implementation. Advantageously, third parties may also identify times and/or user locations when improper helmet usage occurs so that they might intervene and assist with proper helmet implementation. As such, the presently disclosed technology may prove useful to a variety of people including bicycle riders, users of other transportation devices, sports players, as well as parents, guardians, coaches and other third parties desiring to ensure proper helmet usage.

According to one aspect of the present disclosure, features and steps may be provided as retrofit electronics and sensor components for use with pre-existing devices. For example, electronics modules can be configured as add-on devices for positioning on and attachment with an existing helmet and/or activity device. In such examples, helmets and/or activity devices can be provided with advantageous safety features afforded by the present disclosure without significant additional cost or modification requirements. In other examples, electronics modules can be built into the helmet and/or associated activity devices for integrated use and provision to a user.

According to one aspect of the present disclosure, features and steps are integrated within an electronics module associated with a helmet. Such helmet electronics module is configured to be positioned with a helmet worn by a user of a bicycle, other form of personal transportation device, or other activity device. The helmet electronics module may include one or more sensors that indicate whether the helmet is in proper position by a user. The helmet electronics module is further responsible for sending a signal to an electronics module associated with the activity device that indicates the status of the helmet sensors and other desired information associated with the helmet or user.

According to another aspect of the present disclosure, features and steps are integrated within an electronics module associated with an activity device. In one example, if the helmet is not present and/or in the correct position when the activity device is engaged in a given activity, no signal will be sent from the helmet electronics module to the activity device electronics module. In another example, the activity device electronics module will query the helmet electronics module to determine whether the helmet is present and/or positioned properly on a user's head. In yet another example, particular signaling protocols are established between the helmet electronics module and activity device electronics module that help facilitate communication of desired sensor outputs from a safety helmet. For example, handshaking signals or other predetermined communication acknowledgements may be used to coordinate the relay of desired information between the various electronics components. As such, a determination of improper helmet usage may be determined by associated activity device electronics components in a variety of suitable manners A determination of improper helmet usage, based on lack of a signal from the helmet electronics module and/or a post-query or other coordinated signal response indicative of improper helmet positioning, will result in generation of one or more helmet usage alerts. In one example, alerts are provided to a user of the activity device, for example, in the form of audio and/or visual alarms to a user. In another example, alerts are provided to a third party device (e.g., remote monitor, home computer or cell phone) to inform a parent, guardian or other party associated with the user that the activity device is not being used with proper helmet safety. Such alerts may be in the form of text message, audio and/or visual alerts, or other forms of communication and may include additional information such as user identification and user location.

With reference now to the FIGS., example embodiments of the present disclosure will be discussed in further detail.

Example Systems

FIG. 1 depicts an example system 100 for communicating helmet usage according to an example embodiment of the present disclosure. In particular, helmet usage is detected and communicated among selected electronics modules associated with the helmet usage system 100. For example, various electronics modules may be provided relative to a helmet 110, an activity device 120 and a remote device 130.

Helmet 110 is intended for wear by a user of the activity device 120. Users may include operators of the activity device, riders of the activity device, or others for whom proper helmet safety usage is desired. Helmet 110 may include a head portion 112 for positioning on the head of a user, a helmet electronics module 114 and a helmet safety strap 116. Although these are the only features illustrated and discussed relative to FIG. 1, it should be appreciated that still further safety features associated with other helmet embodiments may also be used with the principles disclosed herein. For example, helmets including face shields, full head helmet portions, or other devices may be used with different activity devices such as motorized transportation devices or sports devices used in higher impact activities.

Helmet electronics module 114 generally includes one or more sensors capable of determining usage and positioning information for the helmet 110 and means for communicating such information to a separate location. Although only a single helmet electronics module 114 is illustrated in FIG. 1, it should be appreciated that the various components of helmet electronics module 114 may be integrated in a single device or dispersed across various locations in and around helmet head portion 112, safety strap 116 and/or other parts of helmet 110. For example, sensors used to help determine proper positioning of a user's head may be placed on the inside surface of helmet head portion 112. Sensors used to determine fastening of safety strap 116 may be located in snap components or other strap fastening features associated with safety strap 116 or along interior surfaces of the safety strap 116 including but not limited to the chin guard 117. Such sensors may then be communicatively coupled to other features of the helmet electronics module 114 or activity device electronics module 124, as will be appreciated with further reference to FIG. 2.

Referring still to FIG. 1, activity device 120 may include a variety of transportation devices, including motorized and non-motorized vehicles such as but not limited to bicycles, scooters, skateboards, motorcycles, go-karts, gliders or other paragliding or light aircraft equipment, automobiles and the like. Activity device 120 may also correspond to other sports-related activity devices, such as but not limited to rock-climbing equipment, hockey or lacrosse sticks, and an unlimited variety of other sports equipment and related devices. For purposes of greater understanding of certain aspects of the present disclosure, activity device 120 may be discussed relative to the particular example of a personal transportation device such as a bicycle. However, it will be appreciated by those of ordinary skill in the art that activity device features and steps are not limited to use with just this particular example.

Activity device electronics module 124 generally includes one or more sensors capable of detecting operational indicators informative of when activity device 120 is engaged in one or more given activities. Activity device electronics module 124 also generally may include one or more computing devices for processing information received from sensors located at the activity device 120 and sensors located at helmet 110. The computing device generally may detect when the activity device is engaged in one or more given activities and whether the helmet is present and used in proper positioning by the user.

Although only a single activity device electronics module 124 is illustrated in FIG. 1, it should be appreciated that the various components of helmet electronics module 124 may be integrated in a single device or dispersed across various locations in and around activity device 120. For example, sensors used to help determine a likelihood that the activity device is engaged in a given activity (e.g., riding a bicycle) may include one or more motion sensor(s) located within the wheels to detect rolling activity and/or one or more weight sensors located within the seat to detect user torso placement and/or the pedals to detect user feet placement.

Activity device electronics module 124 also generally may include features for sending and/or receiving data to/from other electronics modules, such as but not limited to receiving data from helmet electronics module 114 via communication link 118 and sending/receiving signals to/from remote device 130 via communication link 126. Communication among the various electronics modules disclosed herein, including but not limited to helmet electronics module 114, activity device electronics module 124, and remote device 130 may be configured in a variety of wired and/or wireless communication links.

Although computing steps and features may be discussed herein as part of activity device electronics module 124, it should be appreciated that such computing devices and corresponding functionality may actually occur within other electronics modules shown in FIG. 1, for example within helmet electronics module 114 or remote device 130. Computing devices and corresponding functionality may also occur in a distributed or coordinated fashion across multiple devices illustrated in FIG. 1 or other remote locations or devices not illustrated.

Referring still to FIG. 1, features are provided in system 100 in order to communicate the helmet usage information determined by the helmet electronics module 114 and activity device electronics module 124. For example, peripheral devices such as audio alarms and/or visual flashes may be provided at activity device 120 to alert a user that the activity device 120 is likely engaged in a given activity during improper helmet usage. In another example, helmet usage information is communicated to a remote device 130. In one example, the remote device 130 may be used by the user such that the alerts are provided via the remote device 130 as opposed to peripheral devices associated with the activity device electronics module. In another example, the remote device 130 may be used by a third party who is interested in monitoring or ensuring proper helmet safety usage. Such third parties may include parents, guardians, sports coaches, physicians, physical therapists or others.

Remote device 130 generally can correspond to any computing device, such as but not limited to a wireless mobile device, wireless monitor, a personal digital assistant (PDA), smartphone, tablet, laptop computer, desktop computer, computing-enabled watch, computing-enabled eyeglasses, gaming console, embedded computing system, or other such devices/systems. In short, remote device 130 can be any computer, device, or system that can interact with the activity device electronics module 124 (sending and receiving data) to implement the present disclosure.

Figure 2:
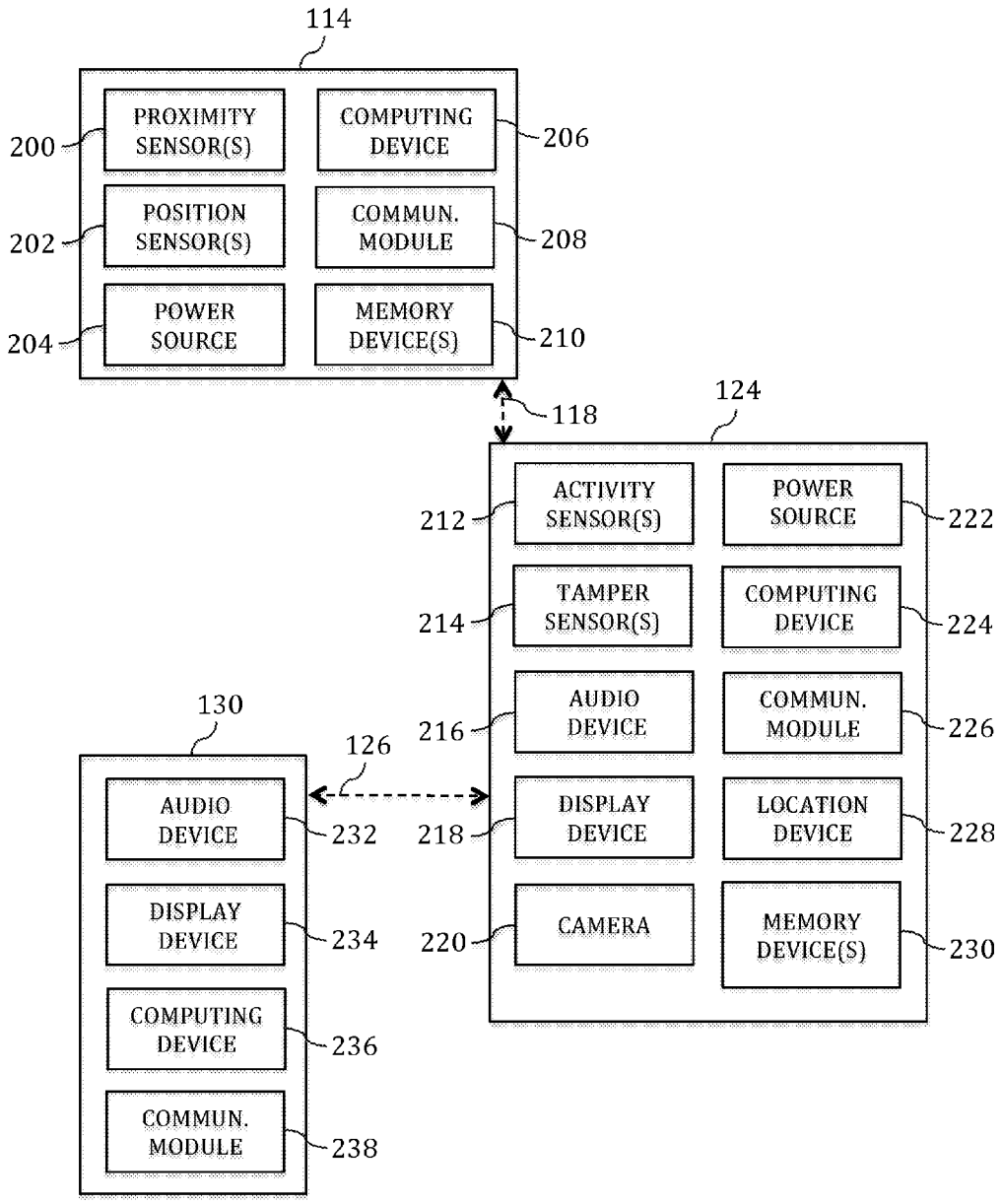
FIG. 2 depicts an example schematic of selected hardware components of a helmet usage system according to an example embodiment of the present disclosure.

Referring now to FIG. 2, additional details of the helmet usage electronics modules and devices shown in FIG. 1 are presented by way of a hardware schematic block diagram. It should be appreciated that the schematic shown in FIG. 2 illustrates one example of helmet usage determination features for implementing the various functions disclosed herein. However, it will be appreciated by one of ordinary skill in the art that such hardware and/or software features may be located within different electronics modules shown in FIG. 2. In addition, the electronics modules may include additional computing or electronics features than those shown in FIG. 2 in order to enhance the functionality thereof or to improve operation of the present disclosure.

The helmet electronics module 114 as shown in FIG. 2 may include such exemplary components as one or more proximity sensors 200, one or more position sensors 202, one or more power sources 204, one or more computing devices 206, one or more communication modules 208, and one or more memory devices 210 for housing data such as but not limited to proximity data from proximity sensor(s) 200, position data from position sensor(s) 202 and user identification data. In one example, user identification data may correspond to data that is hard-wired into a given helmet to identify the intended user of the helmet. In another example, user identification data may correspond to a programmable identifier that is customizable based on the particular user that is wearing the helmet.

Referring still to FIG. 2, some examples of helmet electronics module 114 include a proximity sensor 200. Proximity sensor 200 may be of the type that emits an electromagnetic field or a beam of electromagnetic radiation (e.g., Infrared radiation) and looks for changes in the field or return signal. When proximity sensor 200 is included in helmet electronics module 200, as shown in FIG. 2, then the target of the proximity sensor is the activity device or associated activity device electronics module 124. If the proximity sensor 200 is alternatively included in the activity device electronics module 124, then the target of the proximity sensor 200 is the helmet 110 or associated helmet electronics module 114. In either configuration, the proximity sensor 200 is optionally provided in order to determine instances when the helmet 110 is in proximal location to the activity device 120.

It should be appreciated that some embodiments of the present disclosure may employ different software-based techniques for determining proximity of the helmet and activity device. For instance, instead of providing a proximity sensor 200, the computing devices 206 associated with helmet electronics module 114 or computing devices 224 associated with activity device electronics module 124 could interpret other signals to determine proximity of the helmet to the activity device. For example, the presence of another signal, lack of another signal, and/or strength of such other signals communicated between the helmet electronics module 114 and activity device electronics module 124 may be analyzed to inherently determine relative proximity of a helmet 110 to an activity device 120.

The one or more position sensor(s) 202 provided as part of helmet electronics module 114 are provided in order to determine whether a helmet is properly positioned and/or securely fastened on a user's head. In general, the position sensors 202 are able to unambiguously determine whether a helmet 110 is in the correct position on the user's head as opposed to being provided in an alternative position such as hanging on the handlebars of a personal transportation device, located in a user's backpack, or left at home. The specific type and number of position sensors may vary based on power and weight requirements, both of which may in some examples be preferred as low power and light weight options. The location of position sensors may be designed so as to limit potential interference with other general safety features of the helmet.

Some position sensors 202 may correspond to compass switches, accelerometer and tip switches or tactile sensors such as touch switches or the like that are capable of sending electric signals upon touch or other mechanical actuation. Specific examples of such touch switches may include, but are not limited to: capacitive switches that detect change in body capacitance or other capacitive actuation, resistive switches that detect presence of something electrically conductive, or piezoelectric switches that detect presence via touch pressure or other mechanical force.

The number and location of position sensors 202 used in various embodiments of the disclosed technology can vary. For more affordable options, a single position sensor 202 may be used. However, more sophisticated arrangements of multiple position sensors 202 may be employed to help ensure more particular levels of helmet safety compliance. For example, a single position sensor 202 may be provided at the top interior surface of a helmet head portion 112 to determine if a user's head is fully engaged in the helmet 110. Multiple position sensors 202 may alternatively be provided across different interior surface locations to help ensure proper placement. In still further examples, one or more position sensors 202 may be integrated with a helmet safety strap when it is desired to determine not only that a helmet 110 is properly placed on a user's head, but also that the safety strap 116 is properly fastened. Such optional safety strap position sensors 202 could be placed in a chin guard 117 or other location that would touch the skin surface around a user's face. Alternatively, such optional safety strap position sensors 202 could be placed in snap features or other fastening features associated with a safety strap 116 in order to determine proper fastening of the strap.

Referring still to helmet electronics module 114, it should be appreciated that a basic form of such module 114 might include only the one or more position sensor(s) 202. If more sophisticated electronics functionality is desired at the helmet location, then additional components also may be provided within helmet electronics module 114. In such latter embodiments, a computing device 206 may be provided in order to analyze outputs of the one or more proximity sensor(s) 200 and/or the one or more position sensor(s) 202. Helmet electronics module 214 also may include one or more memory devices 210 that includes non-transitory computer readable media storing instructions that when executed by one or more processors associated with the computing device 206 causes the helmet electronics module 114 to perform various features and steps disclosed herein. The memory device 210 also may be configured to store data detected by the proximity sensor(s) 200 and/or position sensor(s) 202. The memory device still further may be configured to store user identification data associated with user(s) of a helmet so that when helmet usage information is communicated, an identification associated with the helmet user may be communicated as well.

Power source 204 may be designed to provide a desired level of power functionality to helmet electronics module 114 depending on the total electronics power requirements. Power source 204 may be a battery, capacitor, or the like and may correspond to a replaceable or rechargeable power source in some embodiments. In other embodiments of the present disclosure, passive RFID technology may be used for the sensors such that the sensors are activated and energized only when needed via RF interrogation energy. Such passive technology may be used alone or in combination with an additional power source 204. In some examples, power source 204 may be configured to communicate low power information to activity device electronics module 124 and/or to remote device 130.

Communication modules 208, 226 and 238 may optionally be respectively provided in selected embodiments of helmet electronics module 114, activity device electronics module 124 and remote device 130 to facilitate communication among the various electronics modules. The specific hardware and/or software provided in communication modules 208, 226 and 238 may be configured to provide a variety of wired and/or wireless communication links. For example, such electronics modules may be configured to communicate among one another in a wireless fashion using any number of wireless communication protocols, including but not limited to cellular, Wi-Fi, Zigbee, Bluetooth, WLAN 802.11, UWB, USB, IR, or other basic wireless protocols. Specific embodiments may utilize particular protocols for communication, such as SMS text messaging via communication link 126 between activity device electronics module 124 and remote device 130. Communication may also use a variety of communication protocols (e.g., TCP/IP, HTTP, SMTP, FTP), encodings or formats (e.g., HTML, XML), and/or protection schemes (e.g., VPN, secure HTTP, SSL).

Referring now more particularly to activity device electronics module 124 of FIG. 2, such module may include one or more of the following components: one or more activity sensors 212, one or more tamper sensors 214, one or more peripheral output devices such as audio device 216 and/or display device 218, one or more cameras 220, a power source 222, one or more computing devices 224, communications module 226, location device 228 and one or more memory devices 230.

Referring now to the one or more activity sensors 212, such sensors are generally configured to be positioned on an activity device to detect various operational indicators relative to the usage of the activity device 120. For example, activity sensors 212 used to help determine a likelihood that the activity device 120 is engaged in a given activity (e.g., in an exemplary embodiment of a bicycle, that such bicycle is in use) may include one or more motion sensor(s) located within the wheels to detect rolling activity and/or one or more weight sensors located within the seat to detect user torso placement or within the pedals to detect user feet placement. Numerous types, placement and coordination of activity sensors 212 may be incorporated. A variety of different sensor types may also be used, including but not limited to tactile sensors, touch switches, motion sensors, light sensors, temperature sensors, pressure sensors, gravity switches, and others. The activity sensors 212 may be relatively sturdy, easy to attach to the activity device, difficult for a user to remove, and also in locations that will not interfere with device safety and normal course of operation.

The activity device electronics module 124 may use the operational indicators from activity sensors 212 and data defining the same in order to determine a likelihood that the associated activity device is engaged in a given activity. In one example, such determinations may occur within the one or more computing devices 224 functioning in conjunction with one or more memory devices 230. For example, the one or more memory devices 230 may include different activity profile data that defines one or more activity sensor output signals that model an exemplary activity of interest.

For example, model data defining an exemplary activity profile for riding a bicycle may include activity sensor output from the bicycle wheels indicating wheel motion. Additional model data may combine the bicycle wheel motion with activity sensor output from the bicycle seat or pedals indicating the presence of force on these components. Having an activity profile that includes activity sensor output from the seat and/or pedals in addition to wheel motion may help distinguish actual bike riding from a user merely rolling the bicycle along the ground while standing next to the bicycle. Different activity profiles may exist that define one given activity as riding a bike at a speed up to some minimum amount and another given activity as riding a bike at a speed of greater rates. This might help define profiles that alert a user or third party of instances when a user is failing to implement proper helmet safety only when operating the bicycle or other transportation device greater than some predetermined speed. These speeds may even be customized per operator so that younger or novice users may be alerted at lower speeds than older or more advanced users.

Whatever combination of sensor data is used to define an activity profile, at least some of the same activity sensors 212 can be monitored to yield combined data for comparison to the existing profile. A number of data points from the activity profile and the current activity sensor output may be compared to determine whether the similarity between the signals exceeds predefined threshold levels indicative of the activity device likely being engaged in one or more of the given activities. The activity usage data determined by the one or more computing devices 224 may also ultimately be stored in the one or more memory devices 230 for subsequent processing or ultimate selective communication to a user or third party.

According to another aspect of the present disclosure, machine learning techniques can be used to train a classifier on activity sensor output data describing a known activity. In some embodiments, a classifier can undergo supervised training using data (e.g., activity sensor output data) having a known characterization (e.g., model data corresponding to or collected during a known activity). Thereafter, the trained classifier can be employed to classify activity sensor data having an unknown character. For example, activity sensor data can be classified into one of a plurality of classifications corresponding to a plurality of activity profiles.

In another embodiment of the disclosed technology, one or more cameras 220 are used in conjunction with the one or more computing devices 224 and other components of electronics modules 114,124 in order to detect movement of an activity device and whether a user is wearing a helmet. As such, cameras 220 and image analysis performed by computing devices 224 are used to provide computer vision features that perform functions similar to those performed by proximity sensor(s) 200, position sensor(s) 202 and/or activity sensor(s) 212. As such, it should be appreciated by one of ordinary skill in the art that an example of a position sensor could include a camera, and an example of an activity sensor could also include a camera. One or more camera(s) 220 could also be used in addition to the various sensors 200, 202 and 212. For example, a camera 220 can be positioned to capture images of a user's head while the user is operating the activity device. Image profiles can be defined and compared or learning techniques described above can be employed to determine from the captured images whether proper helmet position is present. The same camera 220 or a different camera could also be positioned to capture images near a user such that image changes are analyzed to detect movement of the user and/or activity device. Although camera 220 is shown as part of the activity device electronics module 124, it should be appreciated that it could also be provided as part of the helmet electronics module 114 or as a separate interfaced device.

In some embodiments of the disclosed technology, a determination by computing device 224 that the activity device is likely engaged in one or more given activities will be a triggering event that results in the need to activate or read the output from helmet sensors, including proximity sensor(s) 200 and/or position sensor(s) 202, or to analyze user head/helmet images to determine helmet usage and/or positioning. This would minimize the operation of the sensors, computing devices, and related electronics module hardware as opposed to requiring constant monitoring of such components. Using the example herein of a bicycle operator, once it is determined that a user is likely present and riding a bicycle, the activity device electronics module 124 would query the sensors 200 and/or 202 at the helmet electronics module 114 to determine whether the helmet is properly positioned and secured. In camera vision embodiments where images are detected using one or more cameras 220, a determination that a user is likely operating an activity device triggers analysis of user head/helmet images to determine proper helmet positioning. Such communication between the activity device electronics module 124 and the helmet electronics module 114 could be coordinated by handshaking signals or other known signaling protocols to facilitate efficient and reliable communication of desired information between the devices.

Once the helmet positioning information is obtained by activity device electronics module 124 from helmet electronics module 114, at least one helmet usage signal can be generated. In one example, such helmet usage signal is communicated to a user of the activity device via a peripheral output device. In one example, the peripheral output device includes audio device 216 which could be any type of relatively low-power speaker provided at the activity device or on the user configured to generate an audio output if helmet usage is improper. In another example, a peripheral output device includes display device 218 which could be any type of LED or lighted button and/or video panel configured to provide visual output and alarm to the user of an activity device. In some examples, improper helmet usage would result in generation of both an audio alert via audio device 216 as well as a visual alert via display device 218 in order to get the attention of a user in attempt to correct helmet positioning and/or fastening.

In another example, the helmet positioning information obtained by activity device electronics module 124 is further communicated remotely to a third party associated with remote device 130. The remote device 130 may also selectively include one or more audio devices 232, one or more display devices 234, one or more computing devices, and/or one or more communication modules 238. In some embodiments, information in the form of an alert is communicated to remote device 130 only when the activity device is engaged in a given activity and the helmet positioning is determined to be improper. In other embodiments, more information may be provided to remote device 130 such as lack of helmet usage, or proper or improper helmet usage indications any time the activity device is engaged in any sort of activity.

Referring still to activity device electronics module 124 of FIG. 2, location device 228 may also be provided to determine the location of the associated activity device 120. Location device 228 can be any device or circuitry for analyzing the position of the activity device 120. Location device 228 may determine actual or relative position of activity device by using a satellite navigation positioning system (e.g. a GPS system, a Galileo positioning system, the GLObal Navigation satellite system (GLONASS), the BeiDou Satellite Navigation and Positioning system), an inertial navigation system, a dead reckoning system, based on IP address, by using triangulation and/or proximity to cellular towers or WiFi hotspots, and/or other suitable techniques for determining position. The location information obtained by location device 228 may be communicated to remote device 130 on a constant basis or as part of communicated alerts during selected instances such as improper helmet usage during activity device operation. If children are operating an activity device 120 such as a bicycle, the location information might be helpful for a parent to determine where the child is when the improper helmet usage occurs.

In embodiments of the present disclosure where location device 228 is provided, such features may be used to implement geo-fencing technology, whereby alerts can be generated when a user of the activity device traverses outside of one or more predefined sets of geographic boundaries. Output signals from location device 228 can be compared to the various geographic boundaries or areas defined by a user. Detection that current user location is beyond boundaries or outside an area can then be a triggering event that causes generation of an alarm to the activity device (via, e.g., the audio device 216 and/or display device 218) and/or communication to a third party. For example, a parent may desire that his/her child remains within a fixed radius around the family home, or a school administrator or coach may desire that students or sports players remain within a predetermined location relative to the school or sporting event. Use of geo-fencing technology can help provide an additional level of safety assurance during operation of the subject activity devices.

Referring still to activity device electronics module 124 of FIG. 2, one or more tamper sensor(s) 214 may be provided and configured to generate a tamper signal upon detection that selected hardware components positioned on the activity device have been removed. Upon detection of tamper signals from the one or more tamper sensors 214, signals may be communicated to remote device 130. This would inform the third parties that the electronics or sensors have been removed or that removal was attempted from the bicycle or other activity device.

Power source 222 may be designed to provide a desired level of power functionality to activity device electronics module 124 depending on the total electronics power requirements. In some examples, power source 222 may correspond to a piezoelectric power generation source that is automatically activated upon movement of the activity device. Power source 222 may additionally or alternatively include a battery, capacitor, or the like coupled to such piezoelectric power generation features for storing energy during operation of the activity device. Such a power source would advantageously initiate steps set forth in the present disclosure once the activity device is operating, such as but not limited to the subsequent query of selected sensors, including the one or more position sensors and the one or more activity sensors, and to generate at least one helmet usage indication signal if the helmet placement on a user's head is improper. In some examples where piezoelectric power generation is not provided, power source 222 may be configured to communicate low power information to a user and/or to remote device 130 so that a third party can assist with ensuring proper battery replacement or the like.

It will be appreciated that the term "module" used herein can constitute features implemented in software (e.g., code embodied on a machine-readable medium or in a transmission signal), firmware and/or hardware. In one embodiment, the modules are program code files stored on the storage device, loaded into memory and executed by a processor or can be provided from computer program products, for example, computer executable instructions that are stored in a tangible computer-readable storage medium such as RAM hard disk or optical or magnetic media. In another embodiment, the modules are tangible units capable of performing certain operations as described in this disclosure and can be configured or arranged in a variety of certain manners.

The technology discussed herein makes reference to computing devices, memory devices and data stored therein, software applications, and other computer-based systems, as well as actions taken and information sent to and from such systems. One of ordinary skill in the art will recognize that the inherent flexibility of computer-based systems allows for a great variety of possible configurations, combinations, and divisions of tasks and functionality between and among components. For instance, computing processes discussed herein may be implemented using a single computing device or multiple computing devices working in combination. A computing device can include one or more configurable processors able to implement instantiations from memory to perform operations. Databases and applications may be implemented on a single system or distributed across multiple systems. Distributed components may operate sequentially or in parallel.

Example Methods

Figure 3:
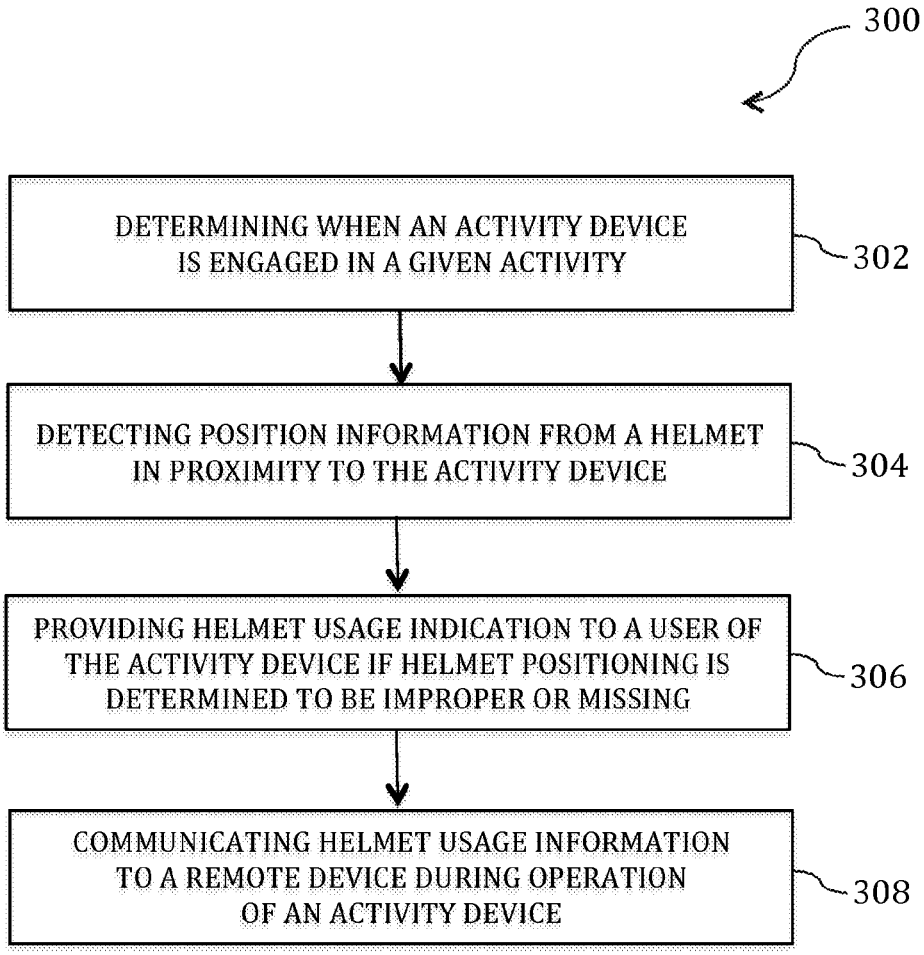
FIG. 3 depicts a flow chart of an example method for communicating helmet usage information during operation of an activity device according to an example embodiment of the present disclosure.
Figure 4:
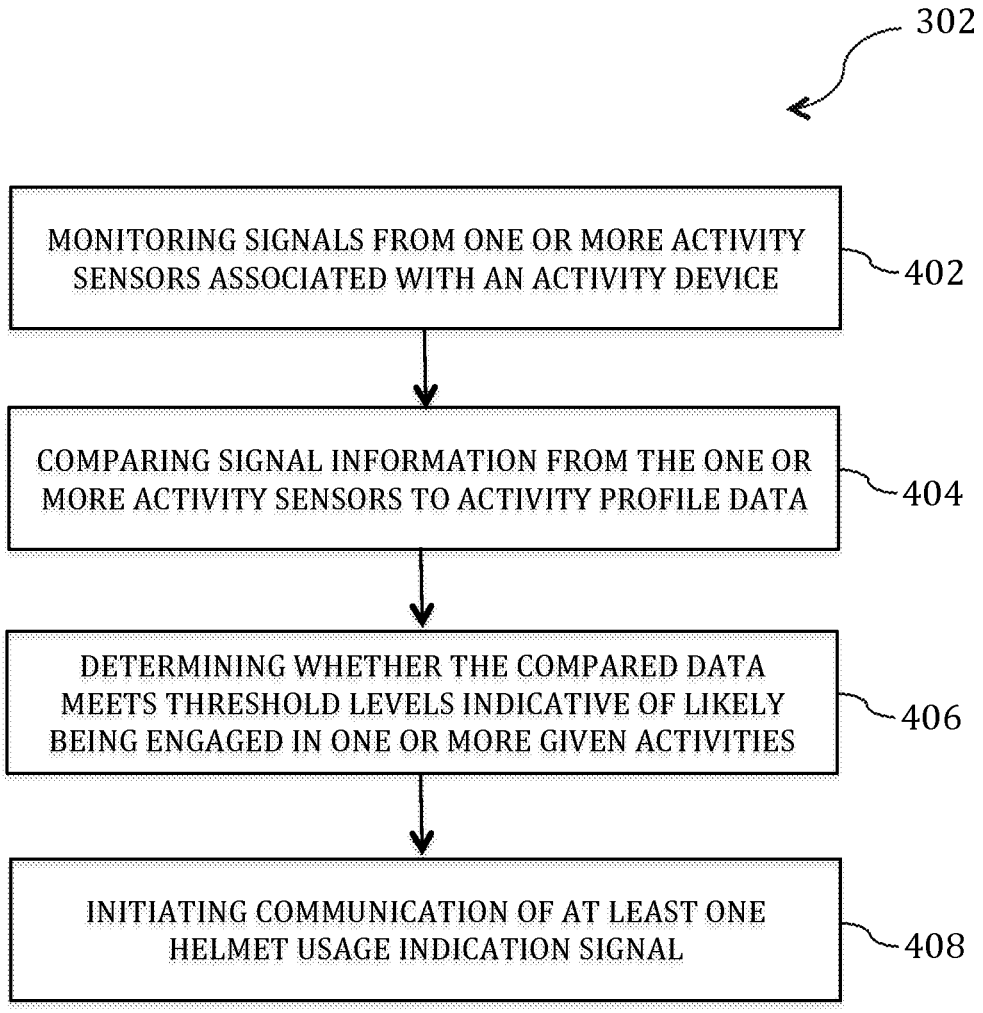
FIG. 4 depicts a flow chart of an example method for determining when an activity device is engaged in an activity according to an example embodiment of the present disclosure.

Methods for communicating helmet usage may include one or more of the steps, features, and techniques described above as capable with the exemplary systems shown in and discussed with reference to FIGS. 1 and 2. Various steps in the methods of FIGS. 3 and 4 are disclosed as being taken by one or more computing devices. It should be appreciated that such steps may be implemented by one or more computing devices provided singularly or in combination with other computing devices. In addition, the computing device (s) that implement such steps may also be operating in conjunction with still further related hardware and/or software components, e.g., memory devices, sensors and the like.

Referring now to FIG. 3, one example method 300 for communicating helmet usage during operation of an activity device is depicted according to an example embodiment of the present disclosure. A determining step 302 in accordance with such method involves determining when an activity device is engaged in a given activity. In accordance with some of the previous examples, determining step 302 may help determine that a user is sitting on and pedaling a bicycle at or above a given speed of operation. In some examples, determining step 302 may also include and/or initiate related steps including but not limited to: detecting movement of the activity device; activating a power source coupled to the one or more computing devices upon movement detection of the activity device; and initiating queries to selected sensors associated with the helmet and the activity device. A more particular example of how determining step 302 is implemented is discussed later with reference to FIG. 4. The system features used to implement determining step 302 may include selected components within the activity device electronics module 124 associated with activity device 120 as shown in FIGS. 1 and 2.

Referring still to FIG. 3, detecting step 304 involves detecting position sensor information received from one or more position sensors 202 associated with a helmet 110 in proximity to the activity device 120. Although not illustrated, proximity sensor information received from one or more proximity sensors 200 associated with helmet 110 may also optionally be detected in the method 300 of FIG. 3. In one example, step 304 of detecting position sensor information includes detecting proper placement of the helmet 110 on the user's head. In another example, detecting step 304 additionally or alternatively includes detecting secure fastening of one or more safety straps (e.g., safety strap 116 of FIG. 1) provided as part of helmet 110. The information detected in step 304 generally corresponds to part of the helmet usage information that may be communicated subsequently and selectively to the user and/or to third party operators of a remote monitoring device.

Once activity device operation is determined in step 302 and helmet position information is detected in step 304, helmet usage information can be provided to a user of the activity device in a variety of manners in accordance with step 306. In one example, providing helmet usage information to a user involves providing helmet usage information to a peripheral device associated with activity device 120. In one example, an audio alarm may be provided to an audio device 216 located at the activity device 120 in order to audibly alert the user of improper helmet positioning or other related helmet usage status. In another example, a visual alarm may be provided to a display device 218 to visually alert the user of improper positioning or other related helmet usage status. In some examples, the audio and/or visual alerts may be implemented only upon determination in step 302 that the activity device is engaged in a given activity and helmet positioning is detected to be improper based on the information obtained in step 304 about helmet position information.

In additional examples of the present disclosure, method 300 of FIG. 3 includes a step 308 of communicating helmet usage information to a remote device 130. Such helmet usage information may, for example, indicate whether the placement of the helmet on the user's head is proper and/or improper while the activity device is determined to be likely engaged in a given activity. The helmet usage information communicated to the remote device 130 can include location information indicating the geographic location of the activity device at the time that the activity device is determined to be likely engaged in the given activity. The location information can be obtained from a location device 228 as depicted in FIG. 2. The helmet usage information communicated to remote device 130 can also include user identification information indicating the current user of the helmet and/or activity device.

Referring now to FIG. 4, additional details are discussed with reference to step 302 of determining when an activity device is engaged in one or more given activities. In one example, step 402 includes monitoring signals from one or more activity sensors 212 associated with activity device 120. The signal information obtained in monitoring step 402, or selected data points thereof, are then compared in step 404 to activity profile data defining what the given activities of interest look like (e.g., riding a bicycle). Step 406 involves determining whether the compared data meets threshold levels indicative of the activity device likely being engaged in one of the given activities. Step 408 then involves initiating subsequent steps associated with helmet usage determination and communication. In some embodiments, the subsequent steps involve providing helmet usage information to a user as per step 306 of FIG. 3 or communicating helmet usage information to a remote device per step 308 of FIG. 4. In still further embodiments, initiating subsequent steps in step 408 involves initiating queries to selected sensors associated with the helmet and the activity device before the subsequent communication of information occurs.

While the present subject matter has been described in detail with respect to specific example embodiments and methods thereof, it will be appreciated that those skilled in the art, upon attaining an understanding of the foregoing may readily produce alterations to, variations of, and equivalents to such embodiments. Accordingly, the scope of the present disclosure is by way of example rather than by way of limitation, and the subject disclosure does not preclude inclusion of such modifications, variations and/or additions to the present subject matter as would be readily apparent to one of ordinary skill in the art.

What is claimed is:

1. A system for communicating helmet usage, comprising:

one or more position sensors configured to be positioned on a helmet, wherein the one or more position sensors are configured to detect placement of the helmet on a user's head and to transmit signals indicative of such placement;

one or more activity sensors configured to be positioned on an activity device, wherein the one or more activity sensors are configured to detect operational indicators relative to the usage of the activity device and to transmit signals indicative of such operational indicators;

one or more computing devices configured to: receive one or more signals from the one or more position sensors and the one or more activity sensors, respectively; determine whether the activity device is likely engaged in one or more given activities based on the one or more signals received from the one or more activity sensors; and generate at least one helmet usage indication signal based on the one or more signals received from the one or more position sensors and the determination of whether the activity device is likely engaged in one more given activities, wherein the helmet usage indication signal provides an indication of placement of the helmet on a user's head while the activity device is determined to be likely engaged in one or more given activities.

2. The system of claim 1, wherein the at least one helmet usage indication signal generated by the one or more computing devices is communicated to a user of the activity device via a peripheral output device configured to be positioned on the activity device.

3. The system of claim 1, wherein the at least one helmet usage indication signal generated by the one or more computing devices is communicated remotely to a third party and indicates whether the placement of the helmet on the user's head is improper while the activity device is determined to be likely engaged in one or more given activities.

4. The system of claim 3, further comprising a location device configured to be positioned in proximity to the activity device, and wherein the one or more computing devices are further configured to remotely communicate location information determined by the location device to the third party.

5. The system of claim 1, wherein the one or more position sensors are further configured for detecting secure fastening of one or more safety straps provided as part of the helmet.

6. The system of claim 1, further comprising an audio device configured to be positioned in proximity to the activity device and to provide audio output to a user of the activity device when the one or more computing devices determine that the activity device is likely engaged in one or more given activities and that placement of the helmet on a user's head is improper.

7. The system of claim 1, further comprising a display device configured to be positioned in proximity to the activity device and to provide visual output to a user of the activity device when the one or more computing devices determine that the activity device is likely engaged in one or more given activities and that placement of the helmet on a user's head is improper.

8. The system of claim 1, further comprising a tamper sensor configured to be positioned relative to the activity device and configured to generate a tamper signal upon detection that selected hardware components positioned on the activity device have been removed.

9. The system of claim 1, wherein the one or more computing devices are further configured to determine whether the activity device is likely engaged in one or more given activities by: comparing signal information from the one or more activity sensors to activity profile data defining the one or more given activities and determining whether the compared data meets threshold levels indicative of the activity device likely being engaged in one or more of the given activities.

10. The system of claim 1, further comprising a power source coupled to the one or more computing devices that is activated upon movement of the activity device.

11. The system of claim 10, wherein activation of the power source associated with the activity device initiates the one or more computing devices to query selected sensors, including the one or more position sensors and the one or more activity sensors.

12. The system of claim 10, wherein the one or more computing devices are further configured upon determining that the activity device is likely engaged in one or more given activities to: query the one or more position sensors positioned on the helmet and generate at least one helmet usage indication signal if the helmet placement on the user's head is improper.

13. The system of claim 1, wherein the one or more computing devices comprise one or more processors and wherein the system further comprises one or more non-transitory computer readable media storing instructions that, when executed by the one or more processors, cause the one or more processors to perform the operations of receiving signals from the one or more position sensors and the one or more activity sensors, determining whether the activity device is likely engaged in one or more given activities, and initiating communication of at least one helmet usage indication signal.

14. A method of communicating helmet usage during operation of an activity device, comprising:

determining, by one or more computing devices using one or more activity sensors associated with an activity device, when the activity device is engaged in a given activity, wherein the one or more activity sensors are configured to detect operational indicators relative to the usage of the activity device;

detecting, by the one or more computing devices, position sensor information received from one or more position sensors associated with a helmet in proximity to the activity device, wherein the one or more position sensors are configured to detect placement of the helmet on a user's head; and providing, by the one or more computing devices, helmet usage information to a peripheral device associated with the activity device based on the one or more position sensors and the determining of when the activity device is engaged in a given activity, wherein the helmet usage information provides an indication of placement of the helmet on a user's head while the activity device is determined to be likely engaged in one or more given activities.

15. The method of claim 14, further comprising communicating, by the one or more computing devices, helmet usage information to a remote device, wherein the helmet usage information indicates whether the placement of the helmet on the user's head is improper while the activity device is determined to be likely engaged in the given activity.

16. The method of claim 15, wherein the helmet usage information communicated to the remote device further includes location information indicating the geographic location of the activity device at the time that the activity device is determined to be likely engaged in the given activity.

17. The method of claim 14, wherein providing usage indication to a peripheral device associated with the activity device comprises one or more of providing an audio alarm to an audio device and providing a visual alarm to a display device.

18. The method of claim 14, wherein detecting position sensor information comprises one or more of detecting proper placement of the helmet on the user's head and detecting secure fastening of one or more safety straps provided as part of the helmet.

19. The method of claim 14, wherein determining when the activity device is engaged in the given activity comprises: monitoring signals from one or more activity sensors associated with the activity device; comparing signal information from the one or more activity sensors to activity profile data defining the given activity; and determining whether the compared data meets threshold levels indicative of the activity device likely being engaged in the given activity.

20. The method of claim 14, further comprising: detecting, by the one or more computing devices, movement of the activity device; activating, by the one or more computing devices; a power source coupled to the one or more computing devices upon movement detection of the activity device; and initiating queries, by the one or more computing devices, to selected sensors associated with the helmet and the activity device.

* * * * *